US006408646B1

(12) United States Patent
Reeves

(10) Patent No.: US 6,408,646 B1
(45) Date of Patent: Jun. 25, 2002

(54) EARRING TO IMPROVE FACIAL APPEARANCE

(76) Inventor: Maxine Reeves, 100 Temple Blvd., Lufkin, TX (US) 75901

( * ) Notice: Subject to any disclaimer, the term of this patent is extended or adjusted under 35 U.S.C. 154(b) by 0 days.

(21) Appl. No.: 09/849,318

(22) Filed: May 7, 2001

Related U.S. Application Data

(60) Provisional application No. 60/206,435, filed on May 23, 2000.

(51) Int. Cl.[7] ..... A44C 7/00

(52) U.S. Cl. ..... 63/12; 63/13; 63/33

(58) Field of Search ..... 63/12, 13, 14.1, 63/14.2, 14.3, 14.4, 14.5, 14.6, 14.7, 14.8, 33

(56) References Cited

U.S. PATENT DOCUMENTS

| | | | | |
|---|---|---|---|---|
| 1,062,399 A | | 5/1913 | Hess et al. | |
| 2,040,083 A | * | 5/1936 | Elliott et al. | 63/14.2 |
| 2,076,282 A | | 4/1937 | Stelfox | |
| 2,079,128 A | | 5/1937 | McKinlay | |
| 2,710,511 A | * | 6/1955 | Baldwin | 63/14.7 |
| 2,823,526 A | * | 2/1958 | Crigler | 63/14.1 |
| 2,971,353 A | * | 2/1961 | Germana | 63/14.7 |
| 3,122,007 A | * | 2/1964 | Horlande | 63/12 |
| 3,238,938 A | | 3/1966 | Jurgovan | |
| 3,465,542 A | * | 9/1969 | Pintarelli | 63/14.4 |
| 3,595,031 A | * | 7/1971 | Weimer | 63/14.5 |
| 3,695,257 A | | 10/1972 | Hale | |
| 4,003,216 A | | 1/1977 | Cecere et al. | |
| 4,471,510 A | | 9/1984 | DeRosa | |
| 4,489,572 A | | 12/1984 | Wilczewski | |
| 4,682,477 A | * | 7/1987 | Vaillancourt | 63/12 |
| 4,993,240 A | | 2/1991 | Pounder | |
| 5,048,311 A | | 9/1991 | Mastrobuono | |
| 5,337,584 A | | 8/1994 | Angeli | |
| 5,438,850 A | | 8/1995 | Keating et al. | |
| 5,444,994 A | | 8/1995 | Poortinga et al. | |
| 5,533,363 A | | 7/1996 | Callisto | |
| 5,582,585 A | | 12/1996 | Nash-Morgan | |
| 5,644,823 A | | 7/1997 | Montaquila | |
| 5,845,518 A | * | 12/1998 | Webber | 63/14.4 |
| D420,934 S | | 2/2000 | Montaquila | |

FOREIGN PATENT DOCUMENTS

| | | |
|---|---|---|
| DE | 000526112 A | 6/1931 |

* cited by examiner

*Primary Examiner*—Jack Lavinder
*Assistant Examiner*—Andrea Chop
(74) *Attorney, Agent, or Firm*—Tom Hamill, Jr.

(57) ABSTRACT

An earring to improve facial appearance is provided. The earring includes a main body which is hingedly affixed to an elongated post element. The post element has a unique structure and is designed to be received through a pair of holes which are made in and through the outer ear. A first hole is located on the region of the outer ear above the earlobe proximal the temporal bone on the pinnae or auricle of the ear and a second hole which is located on the earlobe proper. The earlobe is bent back behind the ear, aligning the first hole with the second hole. The post element would pass through both holes, pinning the earlobe behind the pinnae below the auditory canal. By placing a back or a securing means to the post extending through the folded ear configuration the earring is secured to the ear about the folded earlobe. By this method of attachment of the earring, wrinkles, loose skin, and the like on the face are smoothed out by the pulling action caused by the placement of the earrings. An ornamental cover is placed atop the main body, covering the main body and obscuring the earlobe and region proximal the earlobe.

11 Claims, 5 Drawing Sheets

EARRING TO IMPROVE FACIAL APPEARANCE

This United States Utility Patent Application claims priority from the U.S. Provisional Patent Application entitled "Face Lifting Earrings", Ser. No. 60/206,435, filed on May 23, 2000 by the sole inventor Maxine Reeves.

BACKGROUND OF THE INVENTION

1. Field of the Invention

The present invention relates to earrings employed for beauty treatment and appearance, and particularly to earrings which effect a face lift without resorting to surgery or other invasive procedures.

2. Description of the Prior Art

Devices to improve the appearance of the face by non-surgically removing wrinkles are known. One such device is shown in U.S. Pat. No. 3,695,257 issued to Hale. The patent discloses a face lifting device attachable to pin curls at both temple area of the wearer's head. This device includes a formed ear clasp connected by extensible bands to the pin curls as well as combs similarly connected. The former, are used to erase lines and wrinkles at the cheek and mouth area and minimize flabbiness under the ear area and particularly the neck and underneath the chin.

Another such device is U.S. Pat. No. 3,238,938 issued to Jurgovan. This device employs a flexible sheet or film material coated with pressure sensitive cement which gathers up the loose skin and then adheres it in place proximal the ear. An ornament may be placed on the ear to obscure the scrunched up facial skin.

The above mentioned prior art indicates it to be known to use different non-surgical devices to smooth out wrinkles and sagging skin of the face. However, the prior art does not disclose an earring, which when placed on the ears by the method of the invention, will pull the skin and thus smooth out the wrinkles of the cheek, chin and other areas of the face. Nor does the prior art disclose an earring which secures the earlobe behind the outer perimeter of the lower external ear or pinna by having the earring actually penetrate completely through the earlobe and be secured behind the outer perimeter of the lower external ear. The present invention provides a unique earring structure as well as an unique method of mounting the earring on the ear in order to produce the desired facial de-wrinkling. Other advantages of the present invention over the prior art also will be rendered evident.

SUMMARY OF THE INVENTION

The onset of aging and departure from youth can be seen in a gradual sagging of tissue as the face loses its firmness. A variety of invasive methods including facelift surgery are often employed to remove the tissues and to stretch the skin, returning the face to a younger appearance. Oils, ointments and creams for the face, are arguably a multi-billion dollar a year industry.

The earrings of the instant invention offer a mechanical means to pull the skin and thus smooth out the wrinkles of the cheek, chin and other areas of the face. The earrings and the method that they are used are known as Fler Rings. The process employed is reasonably non-invasive. Two piercings are required to be made on the outer portion of the ear, one on the lower pinna and the second on the earlobe. In this modern world, conventional piercing of the ear is fairly acceptable and well within social norms. It is also affordable for most people.

The invention provides an earring to improve facial appearance. The earring includes a main body which is hingedly affixed to an elongated post element. The post element has a unique structure and is designed to be received through a pair of holes which are made in and through the outer ear. A first hole is located on the region of the outer ear above the earlobe proximal the temporal bone on the pinnae or auricle of the ear and a second hole which is located on the earlobe proper. The earlobe is bent back behind the ear, aligning the first hole with the second hole. The post element would pass through both holes, literally pinning the earlobe behind the pinnae below the auditory canal. By placing a back or a securing means to the post extending through the folded ear configuration the earring is secured to the ear about the folded earlobe. By this method of attachment of the earring, wrinkles, loose skin, and the like on the face are smoothed out by the pulling action caused by the placement of the earrings. An ornamental cover is placed atop the main body, covering the main body and obscuring the earlobe and region proximal the earlobe.

The earring itself has a first portion and a second portion. The first portion includes a thin circular plate. The thin circular plate has a first diameter, a first thickness and a first circumference. The thin circular plate has a top side, a bottom side, a first side and a second side. The bottom side of the thin circular plate has a hinge located on the second side proximal the circumference at a first point. The hinge may be welded to the thin circular plate. The hinge is connected to a L-shaped element. The L-shaped element includes a riser and a post. The riser is connected to and may freely rotate about the hinge. The post is connected to the riser and is disposed at an angle of greater than 45 degrees and less than 90 degrees to the riser. The connection may be a weld or other known connection means. The post is about twice as long as the riser and extends beyond the diameter of the thin circular plate.

The bottom side of the thin circular plate has a latch located on the first side proximal the circumference at a second point. The latch may be welded to the thin circular plate. The first point is one hundred and eighty degrees from the second point. The latch extends perpendicular from the thin circular plate and has a central opening. The central opening is designed to receive the post therein. The central opening includes a plurality of semi-circular cutouts evenly spaced down it's length. These semi-circular cutouts are designed to engage the post. By using different latch engagement points a variety of different angles with respect to the thin circular plate and the post are formed. This effects the amount of skin pulled, and may be adjusted for both comfort and appearance.

There are a variety of other elements located on the post which are designed to fit about the earlobe and the folded portions of the ear which have yet to be defined. These include foam cushioning elements which are designed to be placed intermediate the folds of the ear. The post may be made from gold wire, or a portion of gold and a portion of silver.

The post acts as a conventional earring post in that it is the element which will pass through the skin and flesh of the ear. The post has a proximal side and a distal side. A securing mechanism is designed to slidingly interfit over the distal side of the post. The distal end of the post is rounded.

A second portion or element of the earring is provided. The diameter of the second portion is greater than the diameter of the thin circular plate. The second portion or second element further has a first side and a second side. The second element first side has a sleeve which will slidingly receive the thin circular plate therein. The sleeve includes a central slot which acts as a guide path to permit the hinge, the riser and the latch to interfit thereon. Since the second element is larger than the thin circular plate, the thin circular plate is completely obscured by the second element.

The second element second side may have any of a variety of ornamental displays which may be desirable to one who would be wearing the earring to improve facial appearance.

The earring will be affixed to ear as follows. First, each ear will be individually pierced. A first hole will be placed on the lower portion of the earlobe. A second hole will be placed above the earlobe and near the periphery of the outer perimeter of the ear. This will be repeated for both ears. The ears should be pierced on both earlobes as close as possible to the face. During this process it is important that the piercings be made in the correct location, as well as in the soft flesh of the ear. The piercing must avoid the cartilage or temporal bone to avoid damage to the support structure of the ear.

The thin circular plate will have the second element attached thereto. The second element may be chosen to reflect any ornamental design desired.

The post will be placed through the second (top) hole from the outside to the rear of the ear. The earlobe is then folded upward and behind the ear. The post will then be placed through the first (bottom) hole in the earlobe from the rear of the earlobe to the front of the earlobe. At this point the securing mechanism is placed over the distal end of the post flush against the flesh of the front of the earlobe, securing the earlobe behind the ear. The securing element may be termed "the back". The securing element may be metal or plastic. It has been found that the plastic "back" may be more comfortable in some instances than the metal "back". The post is then retained in the latch. The second element totally obscures from sight the fact that the earlobe is bent back and secured behind the ear. Additionally, the action of pulling the earlobe behind the ear pulls out the sagging or wrinkled skin on the face, giving the skin a less wrinkled and aged appearance.

The components of the earring may be comprised of the following materials. The thin circular plate or disk may be made from sterling silver. The hinge may also be made from sterling silver and may be welded to the disk. The riser may also be made from sterling silver. The ear post may be divided into the upper post and lower post. The upper post may be made of sterling silver which has been heat treated for strength. The lower post may be made of 14 kt gold wire. The latch or catch may be made from sterling silver, preferably hardened, or alternatively gold. The "back" or clutch may be made from sterling silver of plastic. The ornamental cover may be made from silver or gold. The ornamental cover may have any desired ornamental appearance. Additional components include cushioning elements; the cushioning elements have an aperture centrally disposed thereon and are designed to slidingly interfit over the post intermediate the ear folds. The cushioning elements may be made of foam, plastic or other hypo-allergenic materials.

The aforementioned components may be made of alternate materials. Popular materials for earrings include, but are not limited to, gold (any carat or purity), silver (sterling, treated for enhanced or specific material properties), platinum, white gold, stainless steel, and the like. As a matter of fact, any material which has mechanical and material properties which are desirable may be employed.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the invention to provide an earring which, when employed, lifts the skin and flesh of the face, giving the user a more youthful appearance.

It is an object of the invention to provide an earring which, when employed, secures the earlobe in a folded position behind the lower outer (external) ear or pinna.

It is a further object of the invention to provide an earring, which, when employed, reduces the requirements for expensive creams or lotions, as well as expensive cosmetic surgery.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

Figure 1:
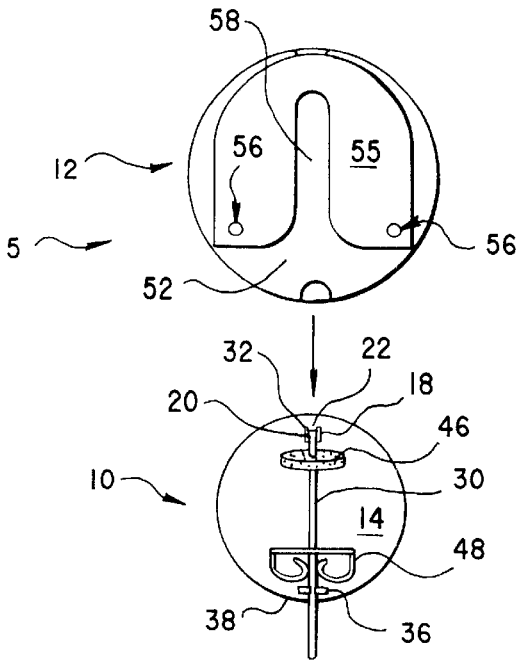
FIG. 1 is a back view of the two portions of the earring before they are interfit.
Figure 2:
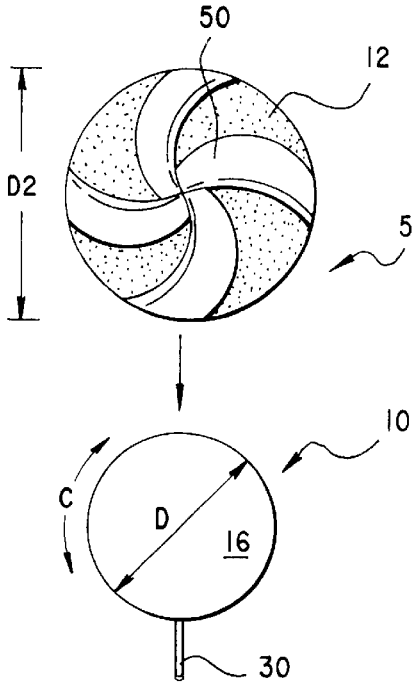
FIG. 2 is a front view of the two portions of the earring before they are interfit.

With reference now to the drawings the earring 5 to improve facial appearance will be described. Turning initially to FIGS. 1–11, the earring 5 is shown with its first portion 10 and its second portion or element 12. The first portion 10 is generally a thin circular plate 10. The thin circular plate 10 has a first diameter D, a first thickness T and a first circumference C. The thin circular plate 10 has a top side 16, a bottom side 14, a first side 24 and a second side 18. The bottom side 14 of the thin circular plate 10 has a hinge 20 located on the second side 18 proximal the first circumference C at a first point 22. The hinge 20 may be welded to the thin circular plate 10 at a first weld 32. A L-shaped element 26 is affixed to the hinge 20. The L-shaped element 26 includes a riser 28 and a post 30. The riser 28 is connected to and may freely rotate about the hinge 20. The post 30 is connected to the riser 28 and is disposed at an angle of greater than 45 degrees and less than 90 degrees to the riser 28. The connection may be a second weld 34 or other known connection means. The post 30 is about twice as long as the riser 28 and extends beyond the diameter D of the thin circular plate 10.

The bottom side 14 of the thin circular plate 10 has a latch 36 located on the first side 24 proximal the circumference C at a second point 38. The latch 36 may be welded at a third weld 40 to the thin circular plate 10. The first point 22 is one hundred and eighty degrees from the second point 38. The latch 36 extends perpendicular from the thin circular plate 10 and has a central opening 42. The central opening 42 is designed to receive the post 30 therein. The central opening 42 includes a plurality of semi-circular cutouts 44 evenly spaced down its length. These semi-circular cutouts 44 are designed to engage the post 30. By engaging the post 30 on a first engagement point A, a first angle with respect to the thin circular plate 10 is formed. By engaging the post 30 on a first engagement point B, a second angle with respect to the thin circular plate 10 is formed. By engaging the post 30 on a third engagement point C, a third angle with respect to the thin circular plate is formed. The first angle is less than the second angle, which is less than the third angle. The amount of facial skin which is pulled is related to the angle formed. The greater the angle formed, the greater the pull on the facial tissue. Therefore, the user has a variety of positions that the earring 5 may be employed in, depending on the comfort and the appearance desired.

There are a variety of other elements located on the post 30 which are designed to fit about the earlobe 80 and the folded portions of the ear 70 which have yet to be defined. These include foam cushioning elements 46 which are designed to be placed intermediate the folds and adjacent to the surface of the ear. The foam cushioning elements 46 may also be made of other suitable material including plastic. The post 30 may be made from gold wire, or a portion of gold and a portion of silver.

The post 30 acts as a conventional earring post 30 in that it is the element which will pass through the skin and flesh of the ear. The post 30 has a proximal side 60 and a distal side 62. A securing mechanism or back 48 is designed to slidingly interfit over the distal side 62 of the post 30. The distal end 64 of the post 30 is rounded.

A second portion or element 12 of the earring is provided. The diameter D2 of the second portion 12 is greater than the diameter D1 of the thin circular plate 10. The second portion or second element 12 further has a first side 52 and a second side 50. The second element 12 first side 52 has a sleeve 55 which will slidingly receive the thin circular plate 10 therein. The sleeve 55 includes a central slot 58 which acts as a guide path to permit the hinge 20, the riser 28 and the latch 36 to interfit thereon. Since the second element 12 is larger than the thin circular plate 10, the thin circular plate 10 is completely obscured by the second element 12. A pair of depressions 56 act to secure the thin circular plate 10 to the sleeve 55.

The second element 12 second side 50 may have any of a variety of ornamental displays which may be desirable to one who would be wearing the earring to improve facial appearance.

Figure 12:
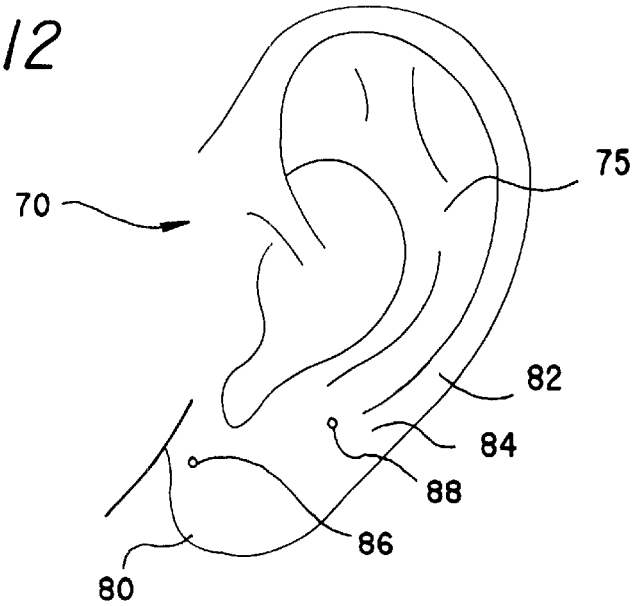
FIG. 12 is a view of a ear, showing the placement of the two piercings required.

Referring now to FIGS. 12–15 the method of employing the earring 5 is shown. FIG. 12 shows the ear 70, the pinna or pinnae 75, the outer perimeter of the ear 82, the lower external ear 84, the earlobe 80, the first piercing 86 and the second piercing 88. It is important that both piercings are made in the soft tissue of the ear, not in the cartilage. It is recommended that a stud earring be used right after the piercings are made, in order to keep the hole open while the ear heals. It is highly recommended that the piercings are permitted 6 weeks or more to completely heal in order to actualize the maximum results by employing the earrings. The piercings must also be placed specifically where instructed in order to actualize the maximum results by employing the earnings.

Figure 13:
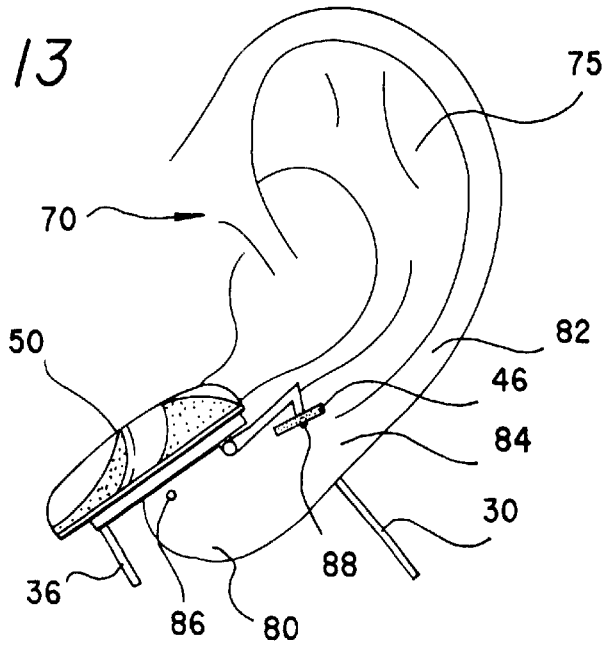
FIG. 13 is a view showing the first step of putting the earring on the ear, placing the post through the first piercing.

FIG. 13 shows the first step of application of the earring 5 after the first piercing 86 and the second piercing 88 have been made and have healed. The post 30 is placed through the second piercing 88. The foam cushioning element 46 may be placed intermediate the riser 28 and the lower external ear 84 if desired for comfort. At this point the earlobe 80 is folded back behind the lower external ear 84 in such a fashion as to align the first piercing 86 with the now post 30 filled second piercing 88. Then, the post 30 is placed through the first piercing 86 and the back 48 is placed through the post 30 flush up against the earlobe 80 which is now effectively pinned behind the ear 70.

Figure 14:
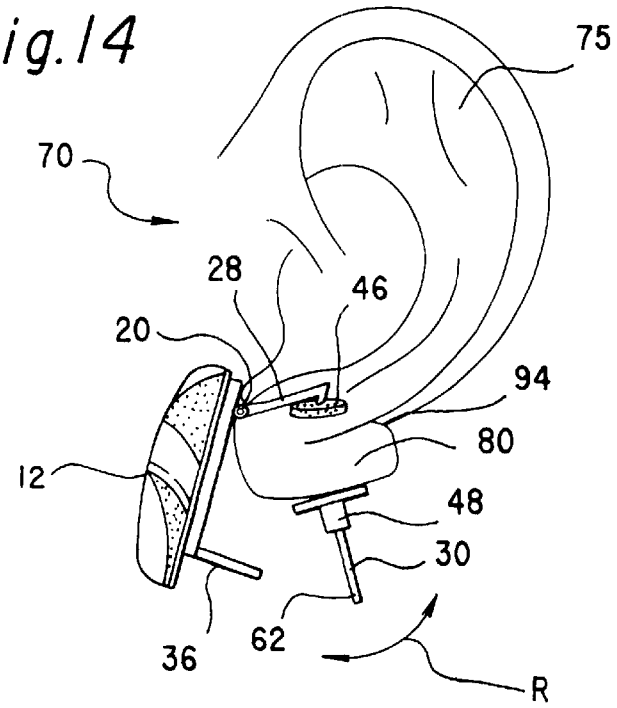
FIG. 14 is a view showing the second step of putting the earring on the ear, placing the post through the second piercing and placing the back on the post, securing the earlobe behind the ear.

FIG. 14 shows the earlobe 80 pinned behind the ear 70 and held in position by back 48. The post 30 distal side 62 extends beyond the earlobe 80. By rotating the second element 12 about hinge 20, latch 36 engages the distal side 62 through the latch central opening 42 where it further is retained in the latch semi-circular cutouts or latch engagement points 44. The rotation about hinge 12 is indicated by arrow R. An earlobe fold line 94 is formed when the earlobe 80 is bent back behind the lower external ear 84.

Figure 3A:
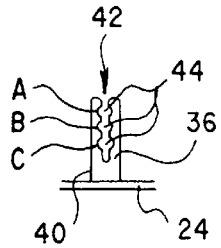
FIG. 3A is a close-up of the latch of the first portion (thin circular plate) showing the three semi-circular attachment points.
Figure 3:
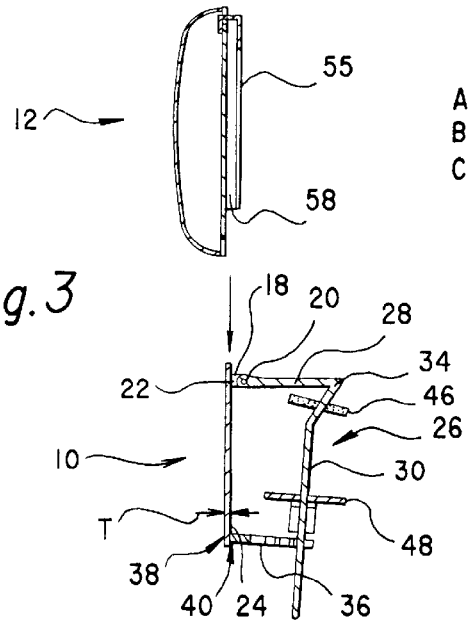
FIG. 3 is a cross-sectional view of the two portions of the earring before they are interfit.
Figure 4:
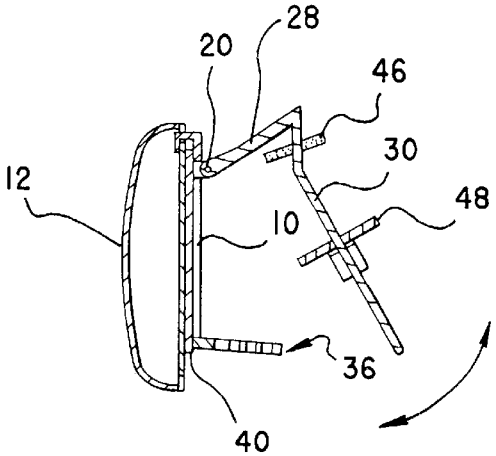
FIG. 4 is cross-sectional view of the earring showing the post prior to mating with the latch.
Figure 5:
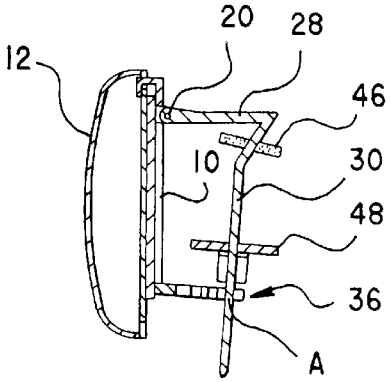
FIG. 5 is a cross-sectional view of the earring showing the post engaged in the first position on the latch.
Figure 6:
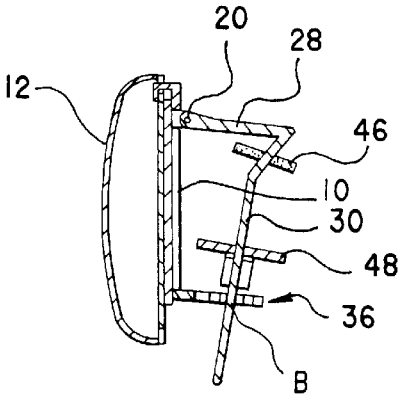
FIG. 6 is a cross-sectional view of the earring showing the post engaged in the second position on the latch.
Figure 7:
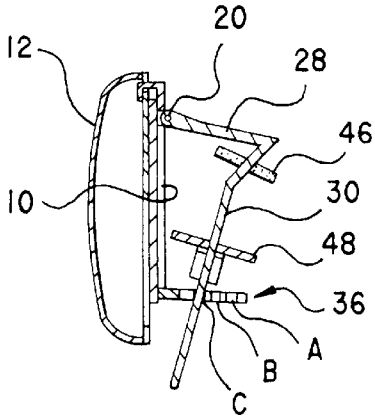
FIG. 7 is a cross-sectional view of the earring showing the post engaged in the third position on the latch.
Figure 8:
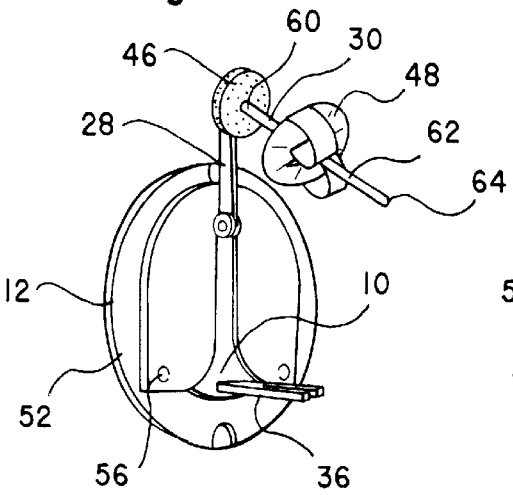
FIG. 8 is a rear perspective view of the earring prior to the post being connected to the latch.
Figure 9:
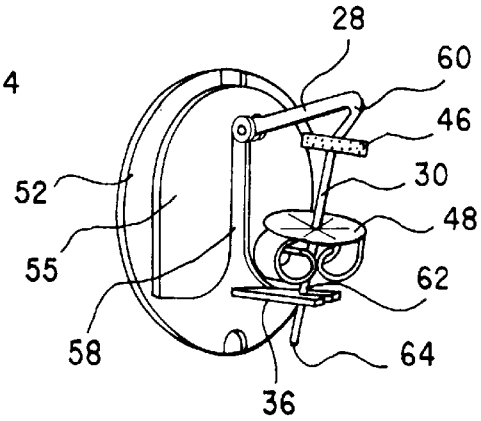
FIG. 9 is a rear perspective view of the earring with the post being engaged by the latch.
Figure 10:
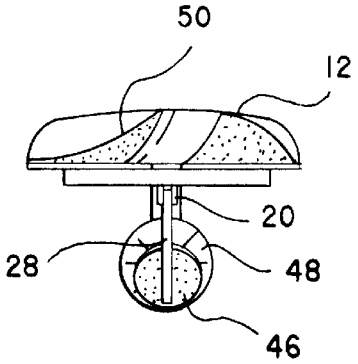
FIG. 10 is a side view of the earring from the riser side.
Figure 11:
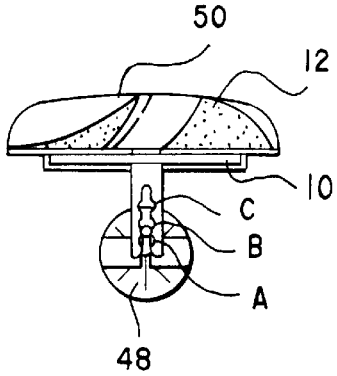
FIG. 11 is a side view of the earring from the latch side.
Figure 15:
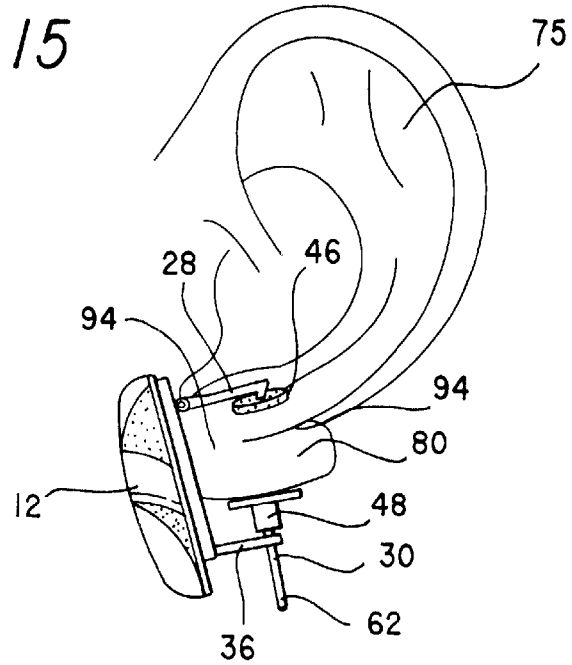
FIG. 15 is a view showing the final step of putting the earring on the ear, engaging the post with the latch.

FIG. 15 shows the earring 5 completely attached to the ear 70. The latch 36 has a plurality of semi-circular cutouts 44. The upper cutout A, the middle cutout B and the lower cutout C are best seen in FIG. 3A. The post 30 distal end 62 is shown engaged with the latch 36. When the post 30 engages semi-circular cutout C, the maximum lift is achieved. When the post 30 engages semicircular cutout B, a lesser lift is achieved. When the post 30 engages the semi-circular cutout A, the least amount of lift is achieved. It is a personal decision of the user which level of lift would be desired. The earrings 5 are designed to be comfortable at any of the three settings. The earring second portion 12 completely obscures all of the rest of the apparatus from view, presenting the world with the ornamental appearance of the second element 12 second side 50. It is to be understood that any of a variety of ornamental designs may be displayed on the second element 12 second side 50. The second element 12 second side may be, but is not limited to, sterling silver, gold, platinum, or other materials and may further include gemstones, pearls and the requisite mountings required.

It is apparent from the above that the present invention accomplishes all of the objectives set forth by providing an earring 5 which, when employed, lifts the skin and flesh of the face, giving the user a more youthful appearance. Further, the present invention, when employed, secures the earlobe 80 in a folded position behind the lower external ear 84.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

I claim:

1. An earring comprising, a first portion, said first portion including a circular disk, said circular disk having a first diameter and a first circumference, said circular disk having a first side and a second side, said second side having a riser and a latch, said riser and latch disposed proximal the circumference and 180 degrees apart, said latch having a central slot, said central slot having a plurality of circular cutouts disposed thereon, said riser having a first side and a second side, said riser first side hingedly connected to said circular disk second side, and said riser second side connected to an elongated post, said post adapted to be received in any of said plurality of circular cutouts, a second portion, said second portion including a second circular disk, said second circular disk having a second diameter and a second circumference, said second circular disk having a first side and a second side, said second side of said second circular disks including a sleeve and said sleeve receiving said first portion first side therein whereby, said post is adapted to pass through a first aperture in an earlobe and said post is adapted to pass through a second aperture in an earlobe which has been aligned with the first aperture by the earlobe being folded back behind the ear, said post thus being adapted to secure the earlobe behind the ear which has the effect of removing the wrinkles from the face.

2. An earring as claimed in claim 1, wherein said plurality of circular cutouts has a first cutout, a second cutout, and a third cutout, where said second cutout is intermediate said first cutout and said third cutout, and said first cutout is closest to said second side of said first circular disk wherein when said post resides in said first cutout, said earring is adapted to achieve the greatest wrinkle removing effect, and when said post resides in said second cutout, said earring is adapted to achieve a lesser wrinkle removing effect, and when said post resides in said third cutout, said earring is adapted to achieve its least wrinkle removing effect.

3. An earring as claimed in claim 1 wherein said second portion first side includes an ornamental design.

4. An earring as claimed in claim 1 wherein said earring further comprises a cushioning element, said post being adapted to receive said cushioning element thereon, said cushioning element being adapted to be located intermediate said riser second side and the ear.

5. An earring as claimed in claim 4 wherein said earring further comprises a back, said post has a portion which is adapted to extend past the second aperture, said portion of said post being adapted to receive said back thereon and said back being adapted to be located adjacent to the earlobe, and being adapted to maintain the earlobe in a folded position.

6. An earring as claimed in claim 1 wherein said sleeve includes a plurality of depressions, said depressions designed to secure said earring first portion to said sleeve.

7. A method of reducing wrinkles on a face having at least one ear, the ear having a lower portion including an earlobe, the earlobe having a lower earlobe and an upper earlobe, and an earring, said earring including a post and a back, the method including the steps of:

making a first pierce in the lower earlobe, making a second pierce in the upper earlobe proximal the lower portion of the ear, bending the earlobe behind the lower portion of the ear and placing said first pierce and said second pierce in alignment, placing said post through said first pierce and said second pierce, sliding said back over said post until flush with the earlobe, whereby the earlobe is secured behind said lower portion of the ear and a portion of said post extends beyond the earlobe.

8. A method of reducing wrinkles as claimed in claim 7 wherein said earring includes a latch directly across from said post, said latch having a first setting, a second setting and a third setting said first setting, said second setting and said third setting adapted to receive said portion of said post therein, said method including the step of placing said portion of said post in one of said settings.

9. A method of reducing wrinkles as claimed in claim 8 including the step of placing said portion of said post in said first setting.

10. A method of reducing wrinkles as claimed in claim 8 including the step of placing said portion of said post in said second setting.

11. A method of reducing wrinkles as claimed in claim 8 including the step of placing said portion of said post in said third setting.

* * * * *